US008960806B2

(12) United States Patent
Wachsmann

(10) Patent No.: US 8,960,806 B2
(45) Date of Patent: Feb. 24, 2015

(54) METHOD FOR OPERATING A GROUND MILLING MACHINE WITH HEIGHT-ADJUSTABLE MILLING ROLLER

(75) Inventor: Steffen Wachsmann, Koblenz (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 13/641,477

(22) PCT Filed: Apr. 15, 2011

(86) PCT No.: PCT/EP2011/001938

§ 371 (c)(1),
(2), (4) Date: Dec. 5, 2012

(87) PCT Pub. No.: WO2011/128114

PCT Pub. Date: Oct. 20, 2011

(65) Prior Publication Data

US 2013/0082507 A1 Apr. 4, 2013

(30) Foreign Application Priority Data

Apr. 16, 2010 (DE) ..... 10 2010 015 173

(51) Int. Cl.
*E01C 23/088* (2006.01)
*E01C 23/12* (2006.01)
*E02F 9/20* (2006.01)

(52) U.S. Cl.
CPC ..... *E01C 23/088* (2013.01); *E01C 23/127* (2013.01); *E02F 9/2025* (2013.01)
USPC ..... 299/1.5; 299/37.1; 299/39.6

(58) Field of Classification Search
CPC ... E01C 23/085; E01C 23/124; E01C 23/127; E02F 9/20
USPC ..... 299/1.05, 1.4, 1.5, 37.1, 39.1, 39.4, 299/39.6
See application file for complete search history.

(56) References Cited

U.S. PATENT DOCUMENTS 3,695,721 A * 10/1972 Jungel ..... 299/37.2
3,750,762 A * 8/1973 Eaton ..... 173/8

(Continued)

FOREIGN PATENT DOCUMENTS

DE 25 40 047 A1 3/1977
DE 10 2006 020 293 A1 11/2007
EP 0 976 872 A1 2/2000

OTHER PUBLICATIONS

Espacenet.com, English Machine Translation of German Application No. DE2540047A1, published Mar. 17, 1977, retrieved from http://worldwide.espacet.com on Sep. 27, 2012 (5 pages).

(Continued)

*Primary Examiner* — David Bagnell
*Assistant Examiner* — Michael Goodwin
(74) *Attorney, Agent, or Firm* — Wood, Herron & Evans, LLP

(57) ABSTRACT

The present invention relates to a method for operating a ground milling machine which comprises at least one height-adjustable milling roller, wherein the milling roller performs a tumbling movement (T') which is controlled by way of open-loop and/or closed-loop control during lowering in operation. The present invention further relates to a control device for the closed-loop and/or open-loop control of this method, and also to a ground milling machine with such a control device.

12 Claims, 2 Drawing Sheets

(56) References Cited

U.S. PATENT DOCUMENTS

| | | | | |
|---|---|---|---|---|
| 3,860,292 | A * | 1/1975 | Bechem | 299/110 |
| 4,343,513 | A * | 8/1982 | Godbersen | 299/1.5 |
| 4,663,868 | A * | 5/1987 | Fauerbach et al. | 37/190 |
| 6,033,031 | A * | 3/2000 | Campbell | 299/39.1 |
| 6,076,289 | A * | 6/2000 | Bitelli | 37/189 |
| 6,921,230 | B2 * | 7/2005 | Silay | 404/84.1 |
| 2007/0194617 | A1 * | 8/2007 | Moller et al. | 299/1.5 |
| 2009/0311045 | A1 | 12/2009 | Jurasz et al. | |
| 2010/0014917 | A1 * | 1/2010 | Willis et al. | 404/93 |
| 2011/0193397 | A1 * | 8/2011 | Menzenbach et al. | 299/1.5 |

OTHER PUBLICATIONS

German Patent Office, English Translation of Claim 1 of German Application No. DE2540047A1, published Mar. 17, 1977 (1 page).

Espacenet.com, English Machine Translation of German Application No. DE102006020293A1, published Nov. 8, 2007, retrieved from http://worldwide.espacet.com on Sep. 27, 2012 (11 pages).

European Patent Office, International Search Report, International Application No. PCT/EP2011/001938, dated Jun. 1, 2012 (2 pages).

The International Bureau of WIPO, International Preliminary Report on Patentability and Written Opinion of the International Searching Authority, International Application No. PCT/EP2011/001938, dated Oct. 16, 2012 (6 pages).

* cited by examiner

METHOD FOR OPERATING A GROUND MILLING MACHINE WITH HEIGHT-ADJUSTABLE MILLING ROLLER

CROSS-REFERENCE TO RELATED APPLICATIONS

The present application is a submission under 35 U.S.C. §371 of International Application No. PCT/EP2011/001938, filed Apr. 15, 2011, which claims priority to German Application No. 10 2010 015 173.4, filed Apr. 16, 2010, the disclosures of which are hereby expressly incorporated by reference herein in their entireties.

FIELD OF THE INVENTION

The present invention relates to a method for operating a ground milling machine which comprises at least one height-adjustable milling roller. The present invention further relates to a control device for performing this method, and also to a ground milling machine.

BACKGROUND OF THE INVENTION

Ground milling machines with height-adjustable milling rollers or milling rotors are known from the prior art, with the milling depth in the ground material (of a road surface cover) to be processed being changed via the height adjustment or being adjusted as required by a specific situation, e.g., with respect to uneven portions of the surface. The height adjustment of a milling roller will be produced by one or several actuators. Reference is hereby made to DE 25 40 047 A1.

The lowering of the milling roller is problematic during the operation of a ground milling machine with a height-adjustable milling roller in order to allow the milling roller to penetrate the ground material (e.g., an asphalt bed) or in order to increase the milling depth of the milling roller which is already in engagement with the ground material. During abrupt or rapid lowering of the milling roller, the drive motor of the ground milling machine can be subjected to loads that exceed its power limit, leading to standstill of the motor or—even worse—to damage thereof. Moreover, the chisels on the milling roller can be damaged.

SUMMARY OF THE INVENTION

It is an object of the present invention to provide measures for avoiding or reducing the problems occurring in the prior art.

A method in accordance with one aspect of the present invention for operating a ground milling machine which comprises at least one height-adjustable milling roller provides that the milling roller performs a tumbling movement that is automatically controlled by way of open-loop and/or closed-loop control.

This ground milling machine can be a construction machine with a driver cabinet (heavy milling machine) or a hand-guided construction machine (small milling machine). Such a ground milling machine is especially a road milling machine or a trench cutting machine.

A tumbling movement means that the milling roller is not lowered in a rigidly straight or rigidly horizontal manner, but that the downward movement is superimposed with a swaying movement of the milling roller axis, thus producing a swaying or staggering lowering movement. In comparison with a rigidly straight lowering of the milling roller, the increase of the braking torque acting on the milling roller will be lower during the lowering with a superimposed tumbling movement. Moreover, the chisels and chisel holders will be protected. Preferably the tumbling movement is guided in such a way that at most only 50% of the milling cutters on an engagement line are in engagement with the ground material. As a result, a more rapid penetration of the milling rotor into the ground material, especially hard ground material, is achieved.

Open-loop control means that the tumbling movement of the milling roller will be performed in a predetermined manner. Closed-loop control, on the other hand, means an automated process in which the tumbling motion is changed in a control loop and adjusted as required by the respective situation. The open-loop and/or closed-loop control preferably occurs in a software-based manner.

Preferably the tumbling movement is a three-dimensional (spatial) staggering movement of the milling roller axis. A three-dimensional staggering movement shall especially mean that at least one end, and preferably both ends, of the milling roller axis perform a rolling motion. This will be described below in greater detail with reference to FIG. 3. The three-dimensional staggering movement is achieved specifically, for example, by the simultaneous downward and upward travel of the rotor in the vertical direction and the forward or rearward travel of the machine.

The tumbling movement can also be a two-dimensional tilting movement of the milling roller axis. Such a two-dimensional tilting movement of the milling roller axis can be produced by an automated alternating actuation of the axially oppositely disposed actuators for height adjustment of the milling roller, thus leading to an alternating pendulum movement of the milling roller axis during the lowering process. This will be explained below in greater detail with reference to FIG. 2. It is necessary in this respect, however, that the actuators can be actuated separately. It is especially provided that during the alternating actuation of the actuators, the occurring tilting angle of the milling roller axis and/or the tilting frequency is controlled by way of open-loop and/or closed-loop control. The respective actuation of the actuators preferably occurs by a control device. Such a control device is especially a controller.

The method in accordance with the present invention offers many advantages. The method in accordance with the present invention ensures that there are fewer malfunctions in milling operation, for example, thereby increasing operating convenience and improving operational reliability of the ground milling machine. Furthermore, the chisels and the chisel holders on the milling roller are protected, which consequently extends service life.

The drive motor of a ground milling machine provides both the driving power required for the travelling drive of the ground milling machine and also for the rotational drive of the milling roller. Furthermore, the drive motor also provides the drive power for the ancillary units such as, for example, the actuators for the height adjustment of the milling roller. The drive motor typically is a diesel engine which originally provides high torque. However, the drive motor can be "killed" if the milling roller is lowered too quickly. Small-size milling machines are especially affected by this problem. Furthermore, components of the drive train can be damaged.

Therefore, according to a preferred further development of the method in accordance with one aspect of the present invention, the momentary speed or power of the drive motor of the ground milling machine will be detected during lowering of the milling roller and the lowering speed of the milling roller will be reduced automatically when the momentary speed or power reaches or falls beneath a critical level. Consequently, the lowering speed over the lowering path (lowering distance) is not constant but variable. The lowering speed of the milling roller will be increased automatically again when the momentary speed or power of the drive motor exceeds the critical level again.

As a result of the automatic reduction in the lowering speed, at least the increase in the braking torque which acts on the milling roller and which is produced by the engagement of the chisels arranged on the milling roller in the ground material will be reduced, so that the drive motor will not be loaded abruptly up to its power limit or beyond. The reduction in the lowering speed occurs in a controlled manner in this case, e.g., by a predetermined amount (by a defined percentage rate for example). Alternatively, a closed-loop control of the lowering speed is possible, as will be described below in greater detail. Within the scope of the present invention, instead of the momentary rotational speed or the momentary power of the drive motor, a corresponding operating parameter such as the momentary rotational speed of the milling roller (especially in the case of a rigid gear ratio) can be detected and compared with a defined critical level. Furthermore, in case of hydraulically driven milling rollers, for example, the pressure and/or the pump volume can be used.

Alternatively or, if necessary, in addition to a control of the lowering speed, during the lowering of the milling roller the momentary speed or power of the drive motor of the ground milling roller will be detected and the lowering speed of the milling roller will automatically be controlled and changed depending on said detected speed or power in a closed-loop control process by way of a control loop. This advantageously provides for the maximum possible lowering speed of the milling roller at any time during operation.

A closed-loop control of the lowering speed means an automatic process in which a change in the lowering speed over the lowering path as required by the current situation will occur in a control loop. On the other hand, an open-loop control of the lowering speed means an automated process in which, if required, the change in the lowering speed over the lowering path will occur in a defined manner, i.e., in a predetermined manner. Prior art milling rollers will be lowered without giving special attention to the lowering speed and especially without open-loop and/or closed-loop control processes related to the lowering speed.

If the construction machine comprises several height-adjustable milling rollers, the lowering can separately or jointly be controlled via open-loop and/or closed-loop control. If several actuators are provided for the height adjustment of a milling roller, the lowering speed can preferably be controlled via open-loop and/or closed-loop control for every single actuator (in a separate or in a common control loop). Despite the tumbling movement, open-loop and/or closed-loop control of the lowering speed of the milling roller is therefore possible. It is also possible to realize a tumbling movement of the milling roller by a separate triggering of the actuators and the respective open-loop and/or closed-loop control of the lowering speeds. The open-loop and/or closed-loop control of the lowering speed can be produced, for example, by a separate adjustment of the hydraulic pressure in the actuators and/or the volume flow (of a hydraulic oil or the like) to the respective actuators.

Further, the closed-loop control process will preferably only occur as long as the momentary speed or power of the drive motor reaches or falls beneath a critical level, and the closed-loop control process will automatically be terminated (again) when the momentary speed or power of the drive motor exceeds the critical level again.

Furthermore, alternatively and/or additionally, the lowering speed of the milling roller can be controlled in a closed-loop and/or open-loop manner depending on the momentary travelling speed of the ground milling machine. This allows for taking into account the influence of the travelling speed of the ground milling machine on the braking torque acting on the milling roller.

In order to prevent the killing of the drive motor, it is also possible to control and thus change the momentary travelling speed of the ground milling machine depending on the momentary lowering speed of the milling roller by way of closed loop and/or open loop control. This can occur as an alternative and/or in addition to other closed-loop and/or open-loop control processes. The idea is finding an operating point during the lowering of the milling roller for the ground milling machine at which the power provided by the drive motor is distributed among the individual consumers (travelling drive, rotational drive, actuators) in the best possible way without loading the drive motor beyond its optimal maximum power point.

BRIEF DESCRIPTION OF THE DRAWINGS

The present invention will be explained below in closer detail by way of example by reference to the enclosed drawings, which schematically show as follows.

DETAILED DESCRIPTION OF THE INVENTION

Figure 1:
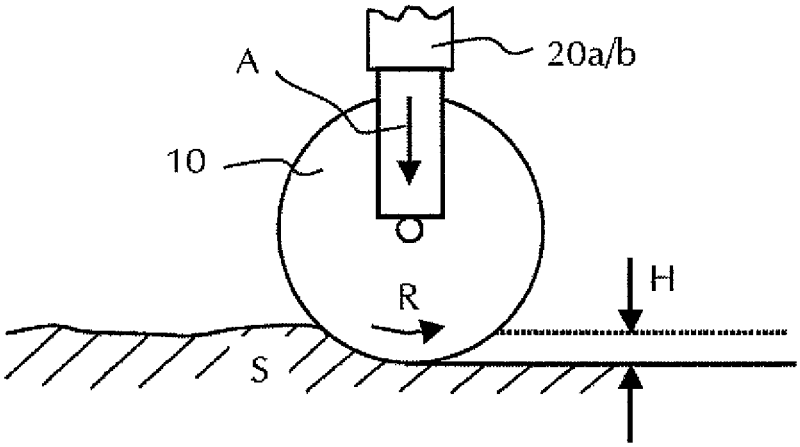
FIG. 1 shows a side view of the engagement of an exemplary height-adjustable milling roller in a ground material.

FIG. 1 shows a milling roller 10 in a schematic side view. The milling roller 10 is arranged in a height-adjustable manner via two actuators 20*a*/20*b* on a ground milling machine (not shown in closer detail). The actuators 20*a*/20*b* are disposed at the axial ends of the milling roller 10, as shown in the front view of FIG. 2. Several chisels (not shown in closer detail) are arranged on the milling roller 10, which chisels loosen and remove ground material S with a defined height H (milling depth) in the stated direction of rotation R (optionally also in the opposite direction of rotation) during rotation of the milling roller 10.

The milling depth H can be changed in milling operation via a height adjustment by means of the actuators 20*a*/20*b*, which especially can be hydraulically actuated actuators (so-called lifting columns). Furthermore, the rotating milling roller 10 can be lowered into the ground material S via the actuators 20*a*/20*b* at the beginning of the milling operation. The lowering movement is indicated with the arrow A.

In the case of an abrupt or too rapid lowering of the milling roller 10, the drive motor of the ground milling machine can be overloaded. In order to avoid this, it is provided that the milling roller 10 performs a tumbling movement which is automatically controlled by way of open-loop and/or closed-loop control during the lowering A during operation. This will be described below in greater detail in connection with FIG. 2.

Figure 2:
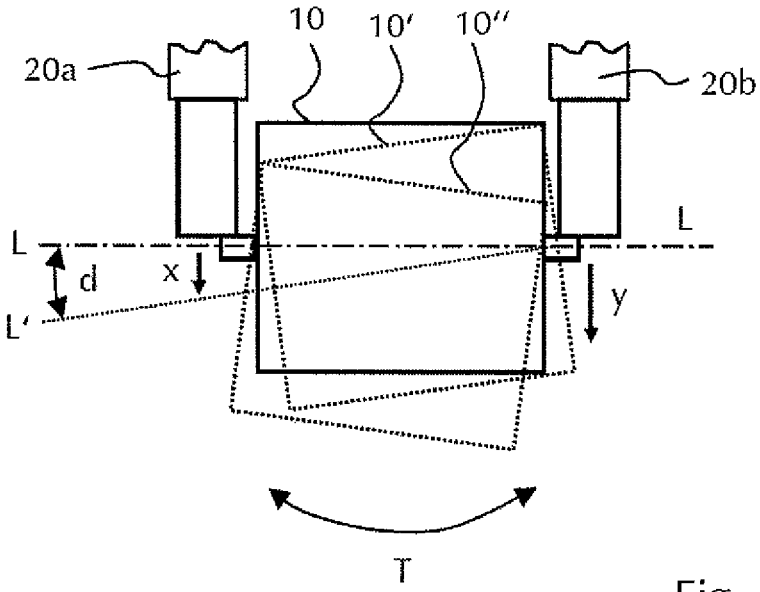
FIG. 2 shows a front view of the lowering of the milling roller of FIG. 1 with a two-dimensional tumbling movement.

FIG. 2 schematically shows the lowering of the milling roller 10 with a two-dimensional tumbling movement (tilting movement) T, with the increase in the braking torque acting on the milling roller 10 being lower than in the case of a straight or horizontal lowering of the milling roller 10. The swaying tumbling movement T will be produced in such a way that at first only the left actuator 20*a* will be actuated, whereupon the left journal bearing of the milling roller 10 will be lowered by the lowering amount x, leading to an angular position of the milling roller axis L of the milling roller 10 about the angle d. Only the right actuator 20*b* will be actuated subsequently, whereupon the right journal bearing of the milling roller 10 will be lowered by the same or a higher lowering amount y. This will be repeated continuously until the milling roller 10 has assumed its new position, with the milling roller axis L being tilted in an alternating fashion (see reference numeral L'). The angular positions of the milling roller 10 which are obtained during the lowering with such a tumbling movement T are shown with a dotted line and are designated with reference numerals 10' and 10".

In order to actualize the tilting movement T, it is not necessary that only one of the actuators 20*a* and 20*b* is actuated. It is also possible that both actuators 20*a* and 20*b* are operated simultaneously but with an alternating different lowering speed.

Figure 3:
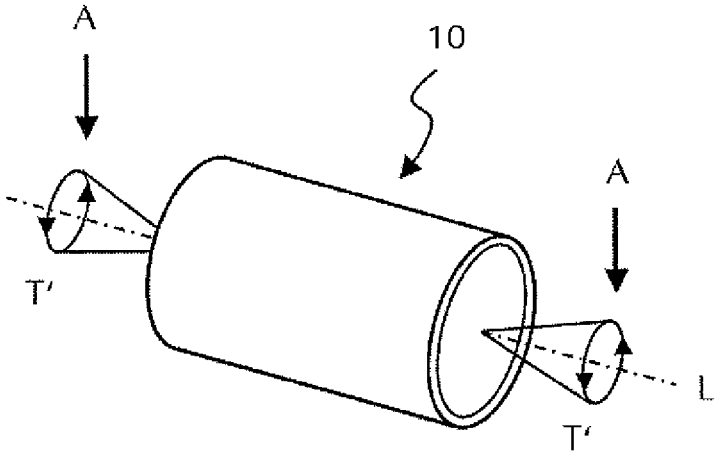
FIG. 3 shows a perspective view of a three-dimensional tumbling movement of the milling roller during lowering.

FIG. 3 schematically shows a three-dimensional tumbling movement (staggering movement) T', in which the axial ends of the milling roller axis L of the milling roller 10 describe a rolling motion on a circular path (optionally also on another trajectory) and a staggering tumbling movement T' of the milling roller 10 is produced thereby. The actuators 20*a* and 20*b* are respectively arranged for performing such a spatial tumbling movement T'. It is also possible that only one of the actuators 20*a* and 20*b* is arranged for performing such a three-dimensional tumbling movement T'.

Figure 4:
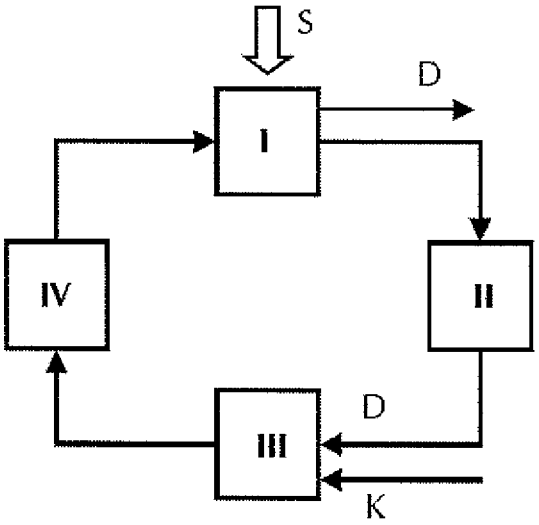
FIG. 4 shows a control loop for the closed-loop control of the lowering speed of the milling roller of FIG. 1.

FIG. 4 schematically shows a control loop for the closed-loop control of the lowering speed of the milling roller 10. The control loop will only be activated during lowering of the milling roller 10 and separately controls the two actuators 20*a* and 20*b* in a closed-loop manner.

Box I represents a momentary (i.e., at a specific time of operation) braking torque acting on the milling roller 10, which braking torque is produced by the engagement of the chisels arranged on the milling roller 10 in the ground material S. The momentary braking torque depends on the ground material S or the condition of the ground (strength, composition, porosity, etc.). The momentary braking torque further depends on the momentary speed of the milling roller 10, the milling depth H and the momentary travelling speed of the ground milling machine (not an exhaustive listing).

At a given drive power of the drive motor of the ground milling machine, a rising braking torque in the milling roller 10 will lead to a reduction in the speed D of the drive motor. Since a lowering of the milling roller 10 leads to an additional increase in the braking torque acting on the milling roller 10, this can lead to the consequence that the system reaches or falls beneath a critical speed level. Box II represents the permanent detection of the momentary speed D of the drive motor.

The detected momentary speed D will be compared with a predetermined critical speed K for monitoring purposes (box III). Once the detected momentary speed D reaches the critical speed K or falls beneath this level, a closed-loop control process will be started in which the lowering speed of the milling roller 10 actualized by means of the actuators 20*a* and 20*b* will be reduced (box IV) until the detected momentary speed D of the drive motor exceeds the critical speed K again. The reduction in the lowering speed can be produced, for example, by a respective triggering of the control valves for the actuators 20*a* and 20*b* (changing the hydraulic pressure in the actuators and/or the volume flow to the respective actuators), with a reduction of the lowering speed down to the value of 0 (stop of lowering movement) also being possible. It is also possible to lift the milling roller 10 slightly in the opposite direction (−A) again. A PID controller (box III) is preferably used for the closed-loop control.

Similarly, for example, the pressure level of the hydraulic drive of the milling roller 10 could also be detected in the aforementioned control loop and compared with a critical pressure level for the purpose of monitoring and/or closed-loop control.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A method for operating a ground milling machine which comprises at least one height-adjustable milling roller having a milling roller axis (L) and an open-loop and/or closed-loop control, comprising controlling a tumbling movement (T, T') of the at least one milling roller by way of the open-loop and/or closed-loop control during lowering (A) of the at least one milling roller in operation, wherein a milling depth H can be changed during milling operation by a height adjustment of the at least one milling roller so that while changing the milling depth H, a tumbling movement is applied to the at least one milling roller comprising a two-dimensional tilting movement (T) of the milling roller axis (L), wherein said two-dimensional tilting movement (T) of the milling roller axis (L) is produced by an automatically alternating actuation of axially opposite actuators for the height adjustment of the at least one milling roller, and further wherein during the alternating actuation of the actuators, a tilting angle (d) of the milling roller axis (L) and/or a tilting frequency will be controlled by way of the open-loop and/or closed-loop control.

2. The method according to claim 1, wherein during the lowering (A) of the at least one milling roller, a momentary speed (D) or power of a drive motor of the ground milling machine will be detected and a lowering speed of the at least one milling roller will be reduced automatically when the momentary speed (D) or power reaches or falls beneath a critical level (K).

3. The method according to claim 2, wherein the lowering speed of the at least one milling roller will automatically be increased again when the momentary speed (D) or power of the drive motor exceeds the critical level (K) again.

4. The method according to claim 1, wherein during the lowering (A) of the at least one milling roller, a momentary speed (D) or power of a drive motor of the ground milling machine will be detected and a lowering speed of the at least one milling roller will be changed depending on the detected speed (D) or power by way of the closed-loop control.

5. The method according to claim 4, wherein the closed-loop control of the lowering speed is produced by a separate adjustment of a hydraulic pressure in axially opposite actuators for the height adjustment of the at least one milling roller and/or a volume flow of a hydraulic medium to the actuators.

6. The method according to claim 4, wherein the closed-loop control will only occur as long as the momentary speed (D) or power of the drive motor reaches or falls beneath a critical level (K), and that the closed-loop control process will be terminated automatically when the momentary speed (D) or power of the drive motor exceeds the critical level (K) again.

7. The method according to claim 4, wherein the lowering speed of the at least one milling roller will further be controlled by way of the closed-loop and/or open-loop control depending on a momentary travelling speed of the ground milling machine.

8. The method according to claim 4, wherein a momentary travelling speed of the ground milling machine is controlled by way of the closed-loop and/or open-loop control depending on the lowering speed of the at least one milling roller.

9. A control device for a ground milling machine which is configured to control the tumbling movement (T, T') of the at least one milling roller according to the method according to claim 1 by way of the closed-loop and/or open-loop control.

10. A ground milling machine comprising the control device according to claim 9.

11. The ground milling machine according to claim 10, wherein the ground milling machine comprises a road milling machine or a trench cutting machine.

12. A method for operating a ground milling machine which comprises at least one height-adjustable milling roller having a milling roller axis (L) and an open-loop and/or closed-loop control, comprising controlling a tumbling movement (T, T') of the at least one milling roller by way of the open-loop and/or closed-loop control during lowering (A) of the at least one milling roller in operation, and further wherein a milling depth H can be changed during milling operation by a height adjustment of the at least one milling roller so that while changing the milling depth H, a tumbling movement is applied to the at least one milling roller comprising a three-dimensional staggering movement (T') of the milling roller axis (L) such that axial ends of the milling roller axis of the milling roller describe a rolling motion on a circular path thereby producing the staggering tumbling movement.

* * * * *